United States Patent [19]

Bundschuh

[11] Patent Number: 4,675,938

[45] Date of Patent: Jun. 30, 1987

[54] RETRACTION DEVICE FOR DOORS OR WINDOWS

[76] Inventor: Robert L. Bundschuh, 6534 Miami Lakes Dr. East, Miami Lakes, Fla. 33014

[21] Appl. No.: 795,325

[22] Filed: Nov. 6, 1985

[51] Int. Cl.[4] ..... E05F 3/16

[52] U.S. Cl. ..... 16/63; 16/64; 16/78; 16/79

[58] Field of Search ..... 16/64, 65, 62, 69, 70, 16/78, 79, 80, 63, 81

[56] References Cited

U.S. PATENT DOCUMENTS

| | | | |
|---|---|---|---|
| 728,488 | 5/1903 | Merrill, Jr. . | |
| 916,455 | 3/1909 | Kush et al. . | |
| 1,040,683 | 10/1912 | Humphrey | 16/64 |
| 1,918,879 | 7/1933 | Welton | 16/64 |
| 2,073,803 | 3/1937 | Phillmore et al. . | |
| 2,635,282 | 4/1953 | Trammell et al. . | |
| 2,658,231 | 11/1953 | Guttormsen . | |
| 2,895,779 | 7/1959 | Bender . | |
| 2,992,450 | 7/1961 | Pittenger . | |
| 3,020,580 | 2/1962 | Glenn . | |
| 3,045,276 | 7/1962 | Schwarz | 16/79 |
| 3,103,034 | 9/1963 | Fisher . | |
| 3,143,773 | 8/1964 | Glenn . | |
| 3,246,363 | 4/1966 | Rogas et al. . | |
| 3,267,513 | 8/1966 | Wartian . | |
| 3,278,979 | 10/1966 | Clement . | |
| 3,332,638 | 7/1967 | Jessup et al. . | |
| 3,334,444 | 8/1967 | Hargrove . | |
| 3,389,422 | 6/1968 | Glenn . | |
| 3,480,227 | 11/1969 | Matthews . | |
| 3,502,280 | 3/1970 | Jessup et al. . | |
| 3,699,608 | 10/1972 | Schwarz . | |
| 3,756,585 | 9/1973 | Mihalcheon . | |
| 4,003,102 | 1/1977 | Hawks et al. . | |
| 4,004,372 | 1/1977 | Beard et al. . | |
| 4,126,912 | 11/1978 | Johnson . | |
| 4,301,623 | 11/1981 | Demukai . | |
| 4,330,960 | 5/1982 | Haseman et al. . | |

FOREIGN PATENT DOCUMENTS

| | | | |
|---|---|---|---|
| 447354 | 5/1936 | United Kingdom | 16/63 |

OTHER PUBLICATIONS

Ametek Hunter Spring Division, Spring-Power Packages, Bulletin FS-201, 1981.

*Primary Examiner*—Fred Silverberg

*Attorney, Agent, or Firm*—Roylance, Abrams, Berdo & Goodman

[57] ABSTRACT

A retraction device for automatically closing a panel, such as a door or window, after the panel has been opened. The retraction device includes a drum, a coiled spring power assembly for driving the drum, a centrifugal brake for controlling the power assembly and the drum to eliminate slamming of the panel during closing, and a gear train transmission assembly to connect the power assembly and the centrifugal brake. In one embodiment, the drum is a spool which carries a cable to connect the panel to the retraction device. In another embodiment, the drum has a rim which frictionally engages a frame supporting the panel. The centrifugal brake is adjustable to take into account a wide range of panel sizes and frictional conditions. This adjustment can be made through an aperture in the device's housing for quick and easy on-site installation. A one-way clutch mechanism is coupled between the power assembly and the brake to actuate the brake only when the panel is being retracted. This clutch mechanism is formed by two members, each of which is integrally molded of plastic.

22 Claims, 16 Drawing Figures

FIG. 8.
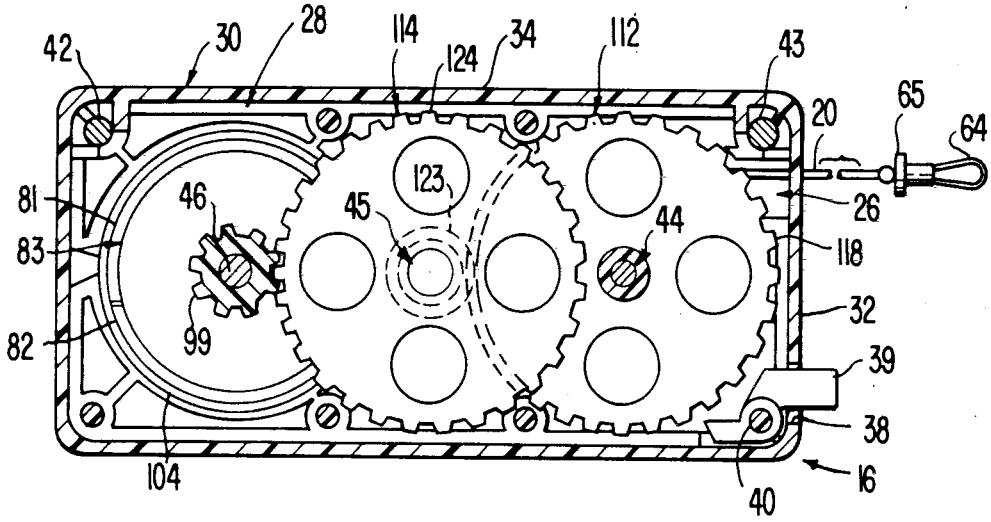
FIG. 9.
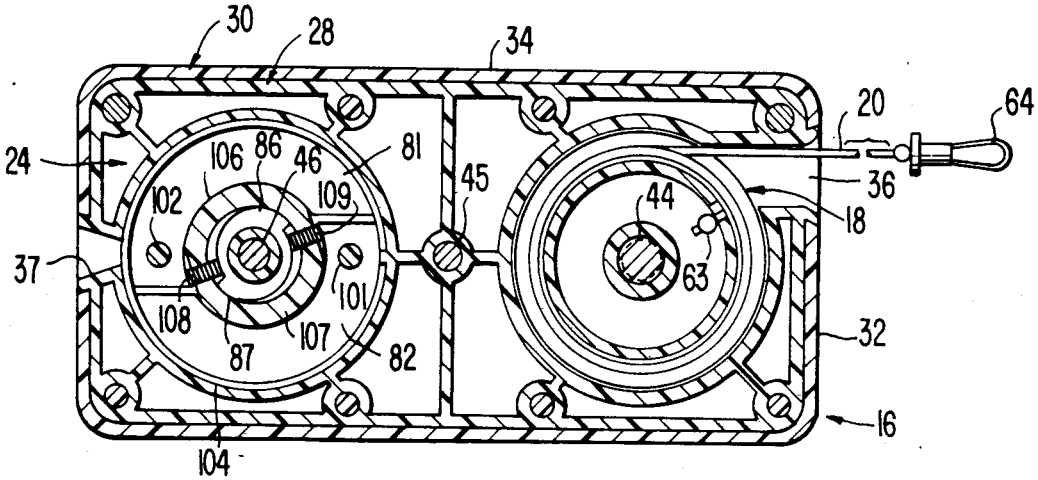
FIG. 10.
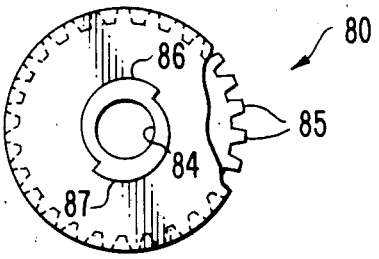
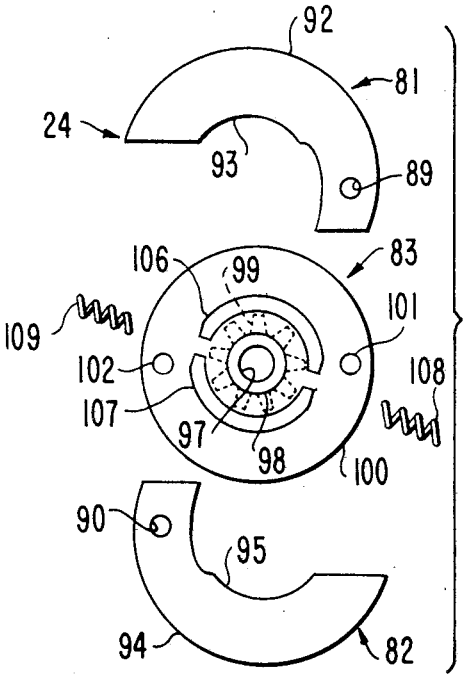
FIG. 11.

RETRACTION DEVICE FOR DOORS OR WINDOWS

FIELD OF THE INVENTION

The invention relates to a retraction device for automatically closing a panel, such as a door or window, after the panel has initially been opened. The retraction device includes a coiled spring power assembly, an adjustable centrifugal brake for controlling the power assembly and a gear train transmission assembly to connect the power assembly and the centrifugal brake.

BACKGROUND OF THE INVENTION

Automatic door and window closers and similar retraction devices for tools and the like are well known in the art. Typically, they comprise a spring or gravity power device to close the window or door once it is pulled open.

However, there are significant disadvantages to the prior art retraction devices and thus there is a continuing need for improvement in this field. Many of these prior art devices are extremely complex, large, unsightly and expensive to manufacture. In addition, the devices which use springs to accomplish the automatic closing typically fail to provide an effective braking feature to prevent slamming of the door or window as it closes. Moreover, many of these prior devices fail to provide an adjustable braking force to take into account doors and windows of differing sizes and frictional conditions. In the devices using pistons with adjustable orifices to control braking, the overall structure of the apparatus tends to be rather large and unsightly.

Examples of these prior art devices are disclosed in the following U.S. Pat. Nos.: 916,455 to Kush et al; 2,635,282 to Trammell, Sr. et al; 2,658,231 to Guttormsen; 2,895,779 to Bender; 2,992,450 to Pittenger; 3,020,580 to Glenn; 3,045,276 to Schwarz; 3,103,034 to Fisher; 3,143,773 to Glenn; 3,246,363 to Rogas et al; 3,267,513 to Wartian; 3,278,979 to Clement; 3,332,638 to Jessup et al; 3,334,444 to Hargrove; 3,389,422 to Glenn; 3,480,227 to Matthews; 3,502,280 to Jessup et al; 3,699,608 to Schwarz; 3,756,585 to Mihalcheon; 4,003,102 to Hawks et al; 4,004,372 to Beard et al; 4,126,912 to Johnson; 4,301,623 to Demukai; and 4,330,960 to Hasemann et al.

SUMMARY OF THE INVENTION

Accordingly, it is a primary object of the invention to provide an automatic retraction device for panels, such as windows or doors, or any extendible device, that has an effective braking assembly to control the retraction speed and avoid slamming of the panel or device upon closing.

Another object of the invention is to provide such a retraction device that has an easily adjustable brake to accommodate panels of varying sizes and frictional conditions.

Another object of the invention is to provide such a retraction device that is easily and quickly adjusted on site by a simple manipulation of the apparatus through the outer housing.

Another object of the invention is to provide such a retraction device that is compact, has a limited number of parts and is relatively easy to manufacture, assemble, install and test for proper non-slamming function.

The foregoing objects are basically attained by providing a retractor, the combination comprising: a housing; a drum rotatably supported in the housing; a power assembly, supported in the housing, for rotating the drum in a first direction after the drum has been rotated in a second, opposite direction; a connecting assembly, coupled to the power assembly and the drum, for connecting the power assembly to the drum; and a brake assembly, coupled to the power assembly, for controlling the brake assembly, thereby controlling the rotational speed of the drum in the first direction, the brake assembly comprising means, responsive to the rotational speed of the drum, for varying the braking force of the brake assembly.

Advantageously, the brake assembly is adjustable so that the retractor can be used with panels of various sizes and frictional conditions. Moreover, the adjustment of the brake assembly can be easily accomplished on site through manipulation of a tool through the housing.

Other objects, advantages and salient features of the invention will become apparent from the following detailed description, which, taken in conjunction with the annexed drawings, disclose preferred embodiments of the invention.

DRAWINGS

Referring now to the drawings which form a part of this original disclosure:

FIG. 8 is a front elevational view in section taken along line 8—8 in FIG. 5 and specifically showing the gear train transmission assembly;

FIG. 9 is a front elevational view in section taken along line 9—9 in FIG. 5 and specifically showing the brake assembly as well as the spool and cable;

FIG. 10 is a front elevational view of the cam wheel used to adjust the brake with the pair of opposed cams being shown in solid lines and the plurality of teeth on the rear of the cam wheel, used to rotate the cams, being shown in dotted lines as well as in solid lines in an area broken away;

FIG. 11 is a rear elevational view in exploded form of the brake assembly including the brake support, a pair of springs, and a pair of centrifugal flyweights which are to be pivotally coupled to the brake support, this brake support also acting as a driven gear;

DETAILED DESCRIPTION OF THE INVENTION

Figure 1:
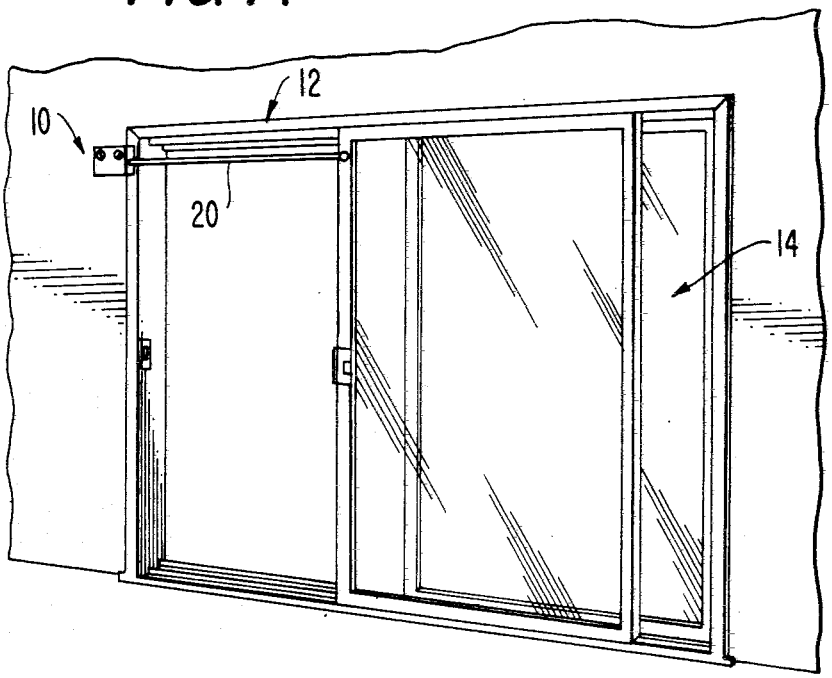
FIG. 1 is a perspective view of the retraction device in accordance with the present invention connected to a door frame for automatically closing the door once it has been initially opened.

Referring now to FIGS. 1–12, the retraction device 10 in accordance with the invention is shown mounted on a frame 12 for automatically closing a sliding door 14 once the door is initially opened. Although shown and described regarding a door, the retraction device 10 can similarly be used to retract a window or for that matter any other thing that can be initially extended and then retracted, such as a tool or a panel. Moreover, the retraction device can be used for swinging doors, windows or other panels.

As will be described in more detail hereinafter, the retraction device 10 basically comprises as seen in FIGS. 1–7 a housing 16, a drum or spool 18, a cable 20 supported by the spool, a coiled spring power assembly 22 coupled to the spool, a brake assembly 24 in the form of a centrifugal brake, and a gear train transmission assembly 26 interconnecting the power assembly and the brake assembly. The device also includes a one-way clutch between the power assembly and the brake assembly so the brake assembly is actuated only when the door is being closed.

As the door 14 is opened, the cable 20 will be unwrapped from the spool and the spool rotated clockwise. When the opened door is released, the power assembly 22 will rotate the spool in the opposite, counterclockwise direction and rewrap the cable around the spool. During this operation, the rotation of the power assembly 22 will be transmitted to the brake assembly 24 via the gear train transmission assembly 26, thereby controlling the rotational speed of the power assembly and spool. The brake assembly 24 is basically a centrifugal brake, whose braking force will vary depending upon the rotational speed of the power assembly and spool to avoid slamming of the door.

As seen in FIGS. 2–5, 7–9 and 12, the housing 16 comprises a base 28 and a cover 30, cover 30 having a left side wall 31, a right side wall 32, a front wall 33, a top wall 34 and a bottom wall 35. The cover and base interconnect and define a first aperture 36 for the cable 20, a second aperture 37 for external adjustment of the brake assembly 24, and a third aperture 38 for lock-out member 39, which can be externally manipulated to lock the retraction device and thus prevent rotation of the spool and powered movement of the cable 20 or door 14. The lock-out member 39 is pivotally coupled to a pin 40 on the cover and can be pivoted into engagement with teeth 118 as seen in FIG. 8.

Figure 2:
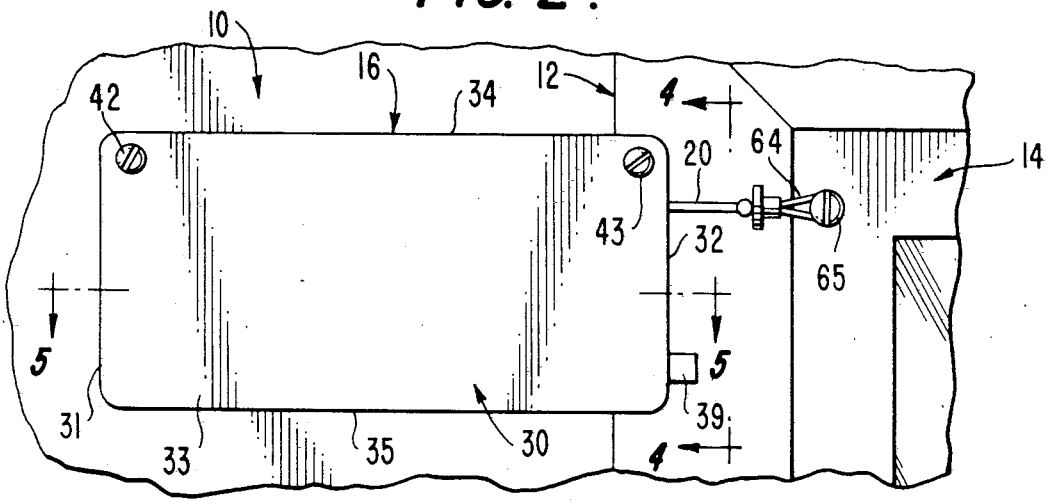
FIG. 2 is an enlarged front elevational view of the retraction device showing the door in the closed position.
Figure 3:
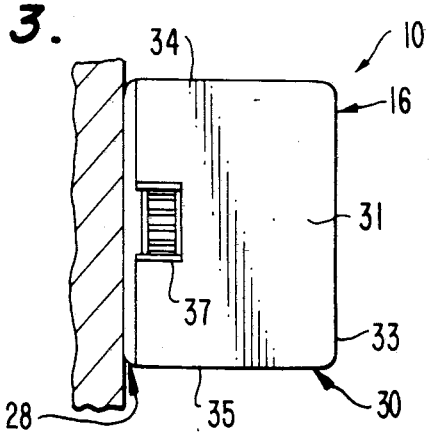
FIG. 3 is a left side elevational view of the retractor shown in FIG. 2 showing an aperture in the housing for external manipulation of the brake assembly.
Figure 4:
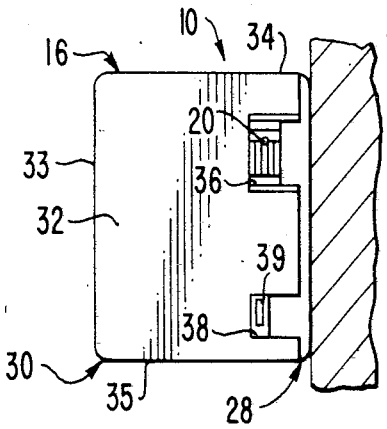
FIG. 4 is a right side elevational view taken along line 4—4 in FIG. 2 showing housing apertures for a cable and a lock-out member.

A pair of mounting screws 42 and 43 pass through suitable through bores in the housing 16 to rigidly couple the housing to the frame 12 as seen in FIG. 2. Alternatively, the housing could be rigidly coupled to the movable door as seen for example in FIG. 16.

As seen in FIGS. 5–9 and 12, the housing 16 supports three parallel shafts including, from right to left, output shaft 44, idler shaft 45, and brake shaft 46.

Figure 5:
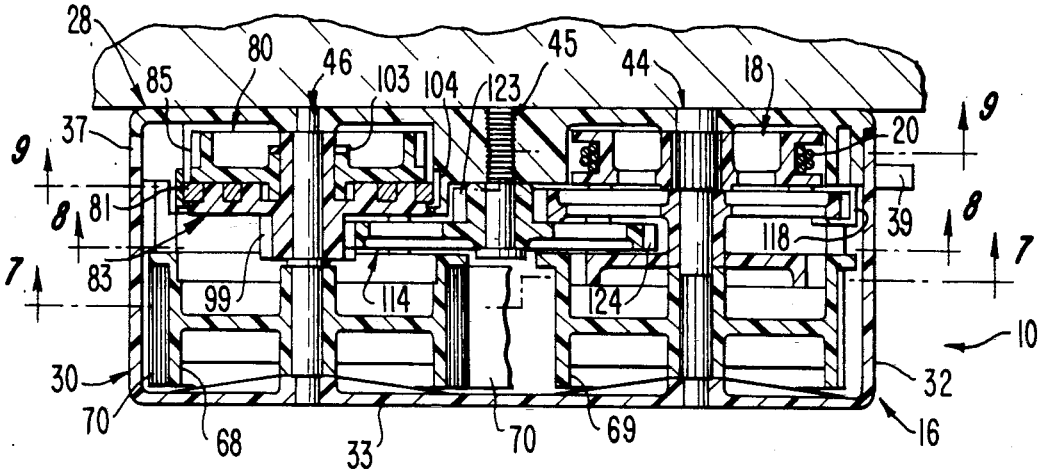
FIG. 5 is a top plan sectional view of the retraction device taken along line 5—5 in FIG. 2.
Figure 12:
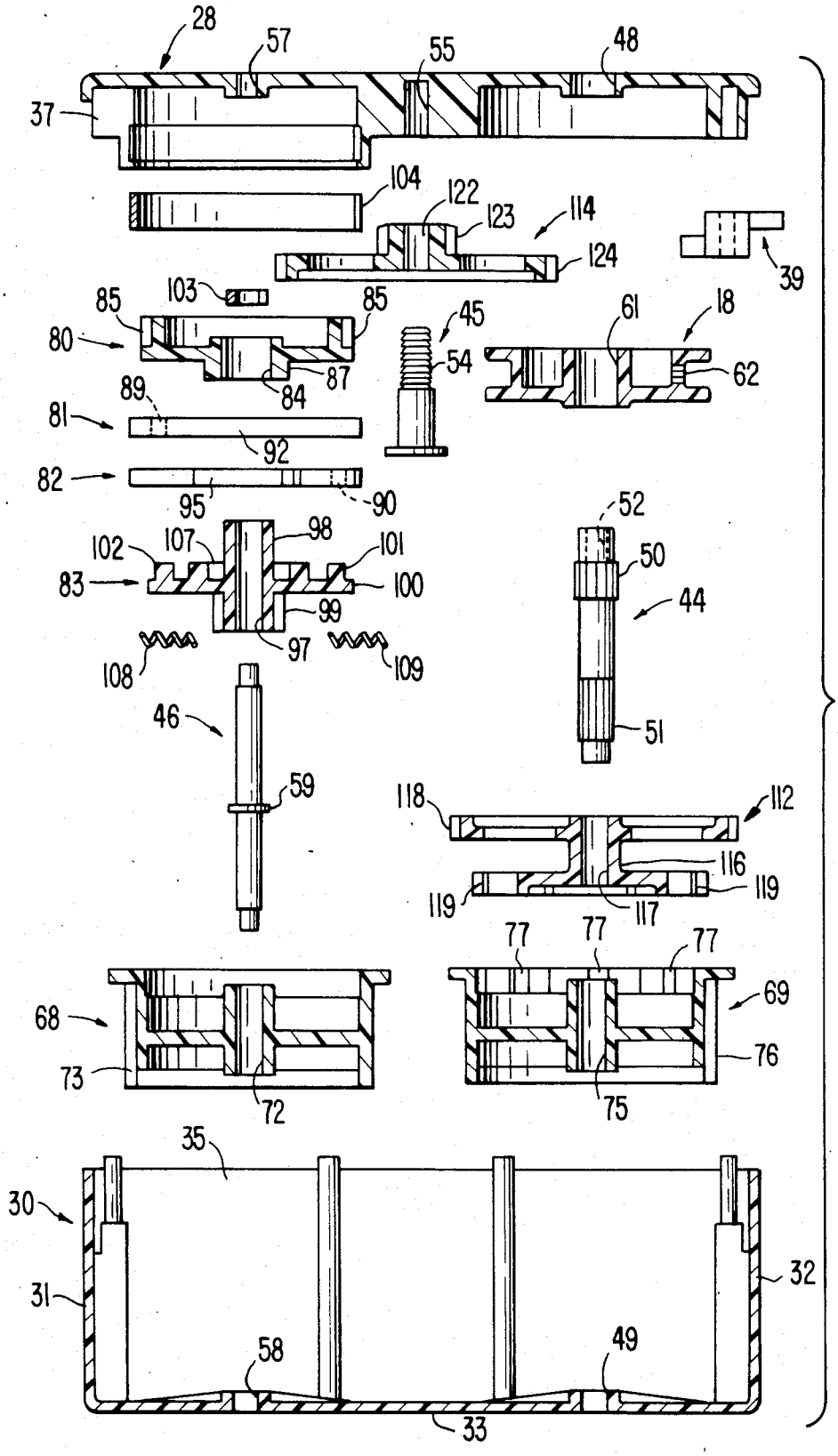
FIG. 12 is a top plan exploded sectional view of the parts of the retractor device shown in FIG. 5 with only the cable and coiled power spring being eliminated therefrom.

As seen in FIGS. 5 and 12, output shaft 44 is received for rotation in opposed bores 48 and 49 located respectively in the base 28 and cover 30. Shaft 44 has two longitudinally extended fluted areas 50 and 51 and has a blind bore 52 at one end having for example a hexagonal cross section. The shaft 44 thus can be rotated upon reception in the bore 52 of a hexagonal wrench. Manipulation of this shaft 44 by such a wrench will also position the spool 20 so that a new cable can be maneuvered thereon in case the old one breaks.

Idler shaft 44 has serrations 54 at one end so that the shaft can be rigidly received in blind bore 55 in base 28 as seen in FIG. 12.

Brake shaft 46 is received for rotation in bores 57 and 58 respectively in base 28 and cover 30. Substantially in the middle of brake shaft 46 is a transverse flange 59 to separate various parts of the device as seen in FIG. 5 and described in more detail hereinafter.

As seen in FIGS. 5, 6, 9 and 12, drum or spool 18 has a central bore 61 for rigidly receiving fluted area 50 on the output shaft 44 and thus rigidly couple the shaft to the spool. The spool has a key slot 62 on its outer periphery to receive an enlarged end 63 on the cable 20 as seen in FIG. 9 to rigidly couple an end of the cable to the spool.

The cable 20 at its other end has an eye 64 so that the cable 20 can be coupled to the door 14 as seen in FIG. 2 via a mounting screw 65 and has an enlarged washer 65 to prevent the eye 64 from entering the housing via aperture 36.

THE POWER ASSEMBLY

The power assembly 22 as seen in FIGS. 5–7 and 12 is basically comprised of a storage drum 68, an output drum 69 and a substantially constant force, coiled band spring 70.

The storage drum 68 as seen in FIG. 12 has a central bore 72 which rotatably receives one end of brake shaft 46, with the central hub of the storage drum 68 abutting flange 59 on that shaft. On the outer periphery of the drum 68 is a radially outwardly opening slot 73 for the reception of a bent end of the coiled spring 70, thereby coupling the spring to the drum. Alternately, the spring can merely be wrapped around the drum without the need for slot 73.

Figure 7:
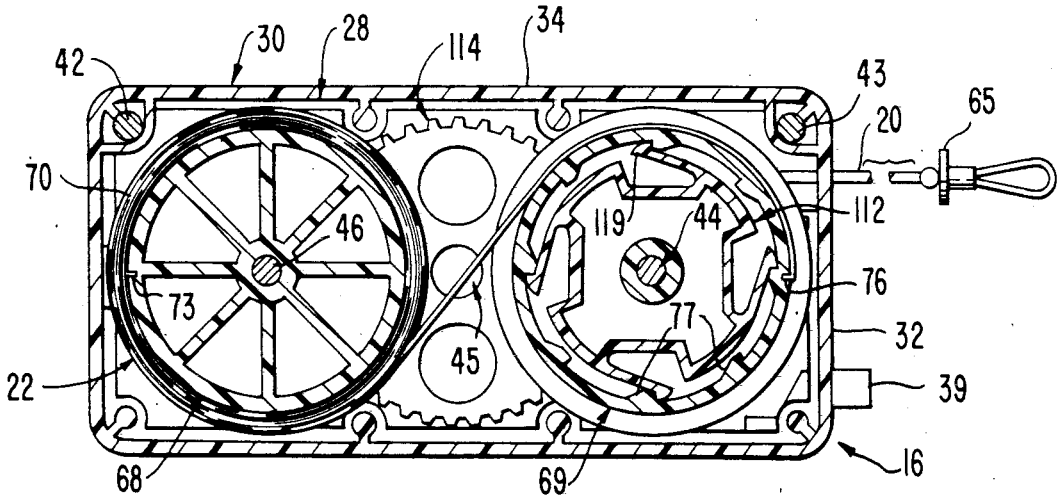
FIG. 7 is a front elevational view in section taken along line 7—7 in FIG. 5 and specifically showing the power assembly.

The output drum 69 is formed of one piece of molded plastic and has a central bore 75 for the reception of the second fluted area 51 on output shaft 44, the output drum 69 thereby being rigidly coupled to the output shaft 44 for rotation therewith. The outer periphery of the output drum 69 has a radially outwardly facing slot 76 for the reception of a second bent end of the coiled spring 70 as seen in FIG. 7 to connect the spring to the drum. In addition, the inner periphery of output drum 69 has integrally formed therewith a plurality of rigid, radially inwardly extending and counterclockwise facing clutch teeth 77 forming in essence a pawl. On their clockwise facing sides, these teeth have tapered cam surfaces.

Figure 6:
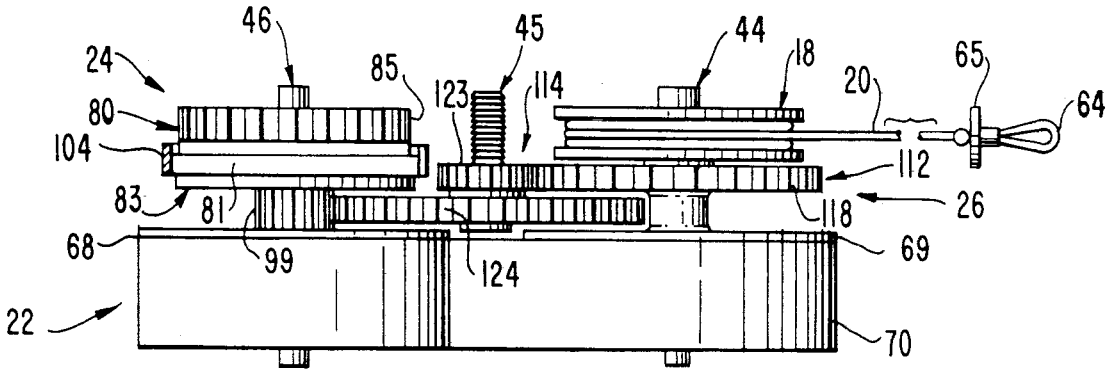
FIG. 6 is a top plan view of the retraction device shown in FIG. 5 without the housing for reasons of clarity.

As seen best in FIGS. 5–7, the coiled spring 70 is wrapped counterclockwise around the outer periphery of the storage drum 68 and extends up and around the output drum 69 clockwise.

Since the spool 18 and the output drum 69 are both rigidly coupled to and thereby connected by the output shaft 44, when the output shaft is rotated clockwise as seen in FIG. 9 by opening the door and paying out of the cable, the output drum 69 will likewise be rotated in a clockwise direction. This will result in unwrapping of the coiled spring 70 from the storage drum 68 and a wrapping of the coiled spring upon the output drum. Because of the inherent force built into the spring, when the opened door is released the spool 18 will rotate in the opposite counterclockwise direction, thereby rewrapping the cable thereabout. Simultaneously, the coiled spring 70 will begin to rewrap around the storage drum 68 and unwrap from the output drum 69.

THE BRAKE ASSEMBLY

The brake assembly 24 as seen in FIGS. 5, 6 and 9–12 comprises a cam wheel 80, two flyweights 81 and 82 and a brake support 83, which also functions as a driven gear.

Cam wheel 80 has a central bore 84 therein and a plurality of radially outwardly facing teeth 85 which are located adjacent the second aperture 37 in the housing so that these teeth can be manipulated with a tool through aperture 37 and rotate the cam wheel. On the front of the cam wheel as seen in FIG. 10 are a pair of opposed curvilinear cams 86 and 87.

The pair of flyweights 81 and 82 are each crescent shaped and extend through about 180°. They have, respectively, pivot bores 89 and 90 at their ends. Flyweight 81 has a curved outer surface 92 and a curved inner surface 93, and flyweight 82 has a curved outer surface 94 and a curved inner surface 95.

Brake support 83 has a central bore 97 in a central hub 98, with bore 97 rotatably receiving brake shaft 46 therein. On the front side of brake support 83, the central hub 98 has a set of gear teeth 99, which are radially outwardly facing. In the center of brake support 83 is a disc-shaped flange 100 having a pair of pins 101 and 102 extending rearwardly and perpendicularly therefrom. These pins are diametrically opposed and are respectively received in bores 89 and 90 in the flyweights to pivotally couple the flyweights to the brake support so that they are displaceable relative to the brake support. Upon counterclockwise rotation of the brake support, the flyweights will tend to pivot outwardly due to centrifugal force to provide the braking force of the brake assembly. During such rotation, the outer surfaces 92 and 94 of the flyweights will forceably engage a split ring liner 104 shown in FIGS. 8 and 9 that is rigidly coupled to the housing and has the flyweights located inside thereof.

On the brake support 83 between the pins 101 and 102 and the central hub 98 are two opposed crescent-shaped ribs 106 and 107 which receive radially extending coiled springs 108 and 109 in the pair of opposed slots formed therebetween.

As seen in FIGS. 5 and 9, central hub 98 of the brake support 83 is received inside bore 84 in the cam wheel 80 to rotatably couple these members together with the flyweights being located in between the cam wheel and brake support and mounted on pins 101 and 102. In this connected condition, the outer surfaces of cams 86 and 87 are located inside the crescent-shaped ribs 106 and 107 on the brake support, and the coiled springs 108 and 109 extend between and engage respective ones of the cams and the flyweights. Thus, the coiled springs tend to bias the flyweights' outer surfaces generally away from the liner 104 and also therefore tend to resist centrifugal force tending to pivot the flyweights counterclockwise as shown in FIGS. 9 and into engagement with the liner 104. A split grip ring 103, received on hub 98, maintains cam wheel 80 axially fixed on the hub, as seen in FIGS. 5 and 12.

In order to adjust the tension of coiled springs 108 and 109 on flyweights 81 and 82, the position of the cams 86 and 87 can be rotated relative to the springs by rotating the cam wheel relative to the brake support. As indicated above, this is accomplished by maneuvering a tool, such as a screwdriver, through aperture 37 and into engagement with teeth 85 on the outer surface of the cam wheel. Thus, as the portion of each cam having a greater radius is moved to engage the coiled spring, the spring will exert a higher force on the flyweight, requiring a larger rotational speed to actuate and energize the braking action of the flyweights. Accordingly, upon installation of the retraction device 10, the actual size of the door and its on-site frictional conditions can be taken into account by adjusting the flyweights in the centrifugal brake thereby formed.

THE TRANSMISSION ASSEMBLY

The transmission assembly 26 as seen in FIGS. 5–8 and 12 comprises a drive gear 112, an idler gear 114 with two sets of gear teeth and the driven gear or brake support 83 having gear teeth 99 thereon.

Drive gear 112 is formed of one piece of molded plastic and has a central hub 116 with a central bore 117 therein, a set of radially outwardly facing gear teeth 118 on the rear of the hub, and on the front of the hub a set of integrally formed, resilient, radially outwardly extending and clockwise facing clutch teeth 119, which have substantially tangential and resilient support arms. Drive gear 112 forms a ratchet wheel to provide a one-way clutch mechanism with teeth 77 on the output drum. These teeth 119 have clockwise facing cam surfaces to slidably engage the cam surfaces on teeth 77. Thus, when the output spool 18 is rotated clockwise upon paying out of cable 20, the output drum will also rotate counterclockwise without rotating drive gear 112 since teeth 77 and 119 will slip and not engage.

Since drive gear 112 is supported for rotation relative to output shaft 44 between the spool 18 and output drum 69 as seen in FIG. 5, drive gear 112 will only rotate when the output drum 69 is rotating counterclockwise after cable 20 is pulled outwardly and released due to the force of spring 70 and the non-slip engagement of teeth 77 and 119 as seen in FIG. 7. In this case, drive gear 112 will rotate in the counterclockwise direction.

The idler gear 114 comprises a central bore 122, a first set of gear teeth 123 which engage gear teeth 118 on the drive gear, and a second set of gear teeth 124 which are larger in diameter and engage gear teeth 99 on the brake support 83. Idler gear 114 is received via bore 122 on shaft 45 for rotation relative thereto.

Thus, the gear train shown in FIG. 6 formed by the transmission assembly 26 comprises a meshing of the clutch teeth 77 on the output drum 69 and the clutch teeth 119 on the drive gear 112, a meshing of gear teeth 118 on drive gear 112 with the first set of gear teeth 123 on the idler gear 114, and a meshing of the second set of gear teeth 124 on the idler gear 114 with the gear teeth 99 on the brake support.

Accordingly, when the output drum 69 is rotating counterclockwise, it will rotate the drive gear 112 counterclockwise, which will in turn rotate the idler gear clockwise, which will in turn rotate the brake support 83 counterclockwise. This counterclockwise rotation of the brake support 83 will in turn provide centrifugal force on the flyweights 81 and 82 which will in turn pivot about their pivot pins 101 and 102 into engagement with liner 104 to provide a braking action on the output drum. Since the output drum has the coiled spring 70 thereon, braking of the output drum will thereby provide a braking force to the storage drum 68 which has the coiled spring 70 wrapped thereon, and which is tending to rotate the storage drum clockwise and the output drum counterclockwise upon release of the previously extended door and cable.

Thus, initially the door 14 is extended, which unwraps the cable 20 from the spool and causes the spool to rotate in the counterclockwise direction. Then, when the door is released, the cable 20 is rewrapped on the spool as the spool turns counterclockwise under the influence of the coiled spring 70. This counterclockwise rotation is accordingly controlled by the centrifugal brake assembly 24 as discussed above.

Advantageously, all of the parts discussed above are made from plastic, except for the shafts and liner, which are advantageously formed of steel. In addition, the flyweights can be made of steel or a plastic composite and advantageously the material forming the drive gear and including teeth 119 is formed from a durable plastic such as that manufactured under the trademark Delrin.

Advantageously, the retraction device 10 can weigh less than a pound and have exterior dimensions of $2\frac{3}{8}'' \times 4\frac{3}{4}'' \times 1\frac{7}{8}''$. For a door weighing about 95 pounds and measuring about six feet eight inches high and 48 inches wide, spring 70 provides tension on the cable of about 3.76 to about 4.08 pounds, or about 2.35 to 2.55 inch-pounds of torque on the spool. Rather than using a constant force band coiled spring, a spiral spring of non-constant force can be used. In all events, retraction device 10, while closing the door 14, keeps the closing speed to about 6 inches/second or less and thereby avoids slamming when the centrifugal brake is properly adjusted.

In a preferred embodiment, the speed-increasing gear ratio between the output drum and the brake is 1 to 16. Thus, drive gear 112 can have about a two-inch diameter and 64 teeth, idler gear 114 first set of gear teeth 123 can have about a one-half inch diameter and 16 teeth, the second set of gear teeth 124 can have about a two-inch diameter and 64 teeth, and the gear teeth 99 can have a diameter of about one-half inch and 16 teeth.

EMBODIMENT OF FIGS. 13–15

Figure 13:
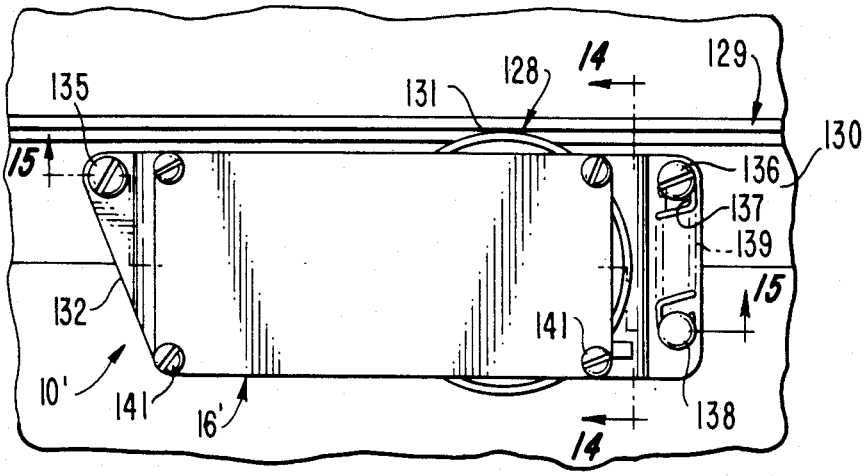
FIG. 13 is a front elevational view of a modified retraction device in which a cable is not used, but instead a rim coupled to the output drum directly engages the frame supporting the door.
Figure 14:
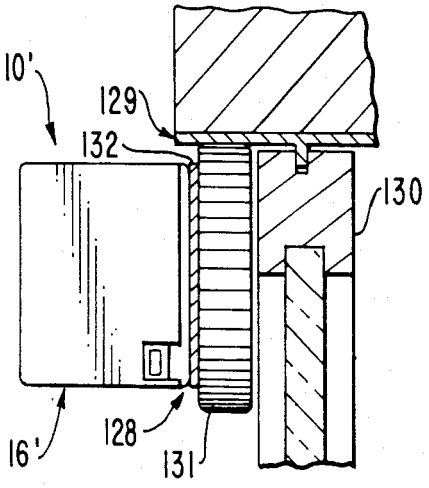
FIG. 14 is a right side elevational view in section taken along line 14—14 in FIG. 13 showing the connection of the rim to the frame.
Figure 15:
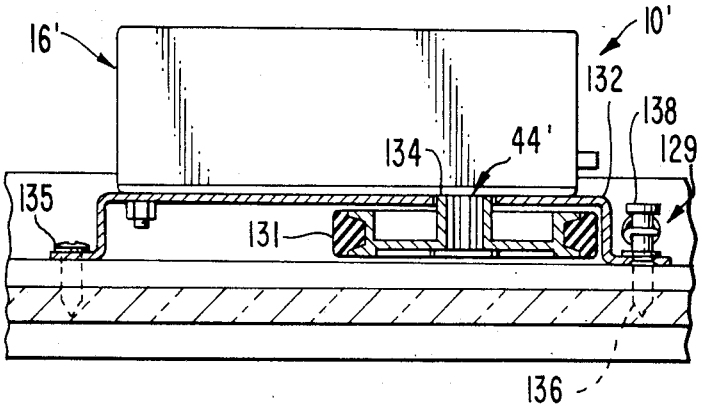
FIG. 15 is a bottom plan view in section taken along line 15—15 in FIG. 13.

As seen in FIGS. 13–15, a modified retraction device 10' is shown where the cable connection is eliminated and instead a drum 128 is utilized to frictionally engage the frame 129 supporting door 130.

Basically, the retraction device 10' is the same as that shown in FIGS. 1–12 and discussed above, except that the cable and spool are not used and the output shaft 44' extends out through a suitable aperture in the housing 16' and is rigidly coupled to drum 128. This drum has, for example, a ribbed rubber outer rim 131 which provides a high frictional engagement with the frame 129.

A bracket 132 has a bore 134 therein to receive the shaft 44' and at one end has a mounting screw 135 passing through a suitable bore and pivotally coupling the bracket to the door 130. A second mounting screw 136 is rigidly received in the door and is slidably received on the bracket via a vertical slot 137. Below the slot is a pin 138 which is rigidly connected to the bracket. A coiled spring 139 engages pin 138 and screw 136 to upwardly bias the bracket 132, retraction device 10' and drum 128 upwardly into engagement with the downwardly facing planar frame 129. The retraction device 10' is suitably rigidly connected to the bracket via screws 141.

Thus, when the door is opened, the drum 128 will be rotated in one direction and then when the door is released, the drum will rotate in the opposite direction due to the power assembly inside the retraction device. Thus, the door will automatically close under the influence of this power assembly and be braked by a similar brake assembly as described above in the embodiment of FIGS. 1–12.

EMBODIMENT OF FIG. 16

Figure 16:
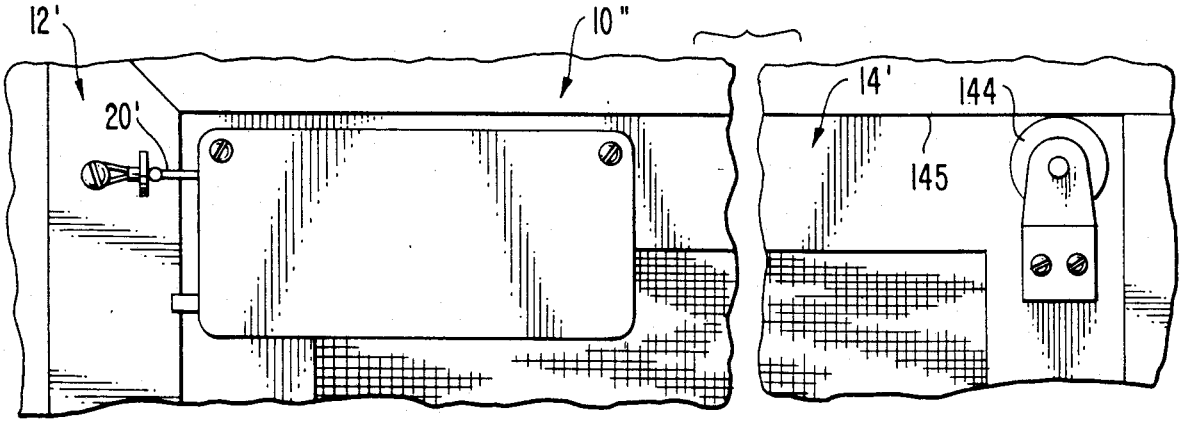
FIG. 16 is a front elevational view of the retraction device in accordance with FIGS. 1–12 shown coupled to the door directly and having an auxiliary roller at the end of the door, which is advantageously used when the door is of light weight, such as a screen door.

In FIG. 16, a retraction device 10'' is shown which is similar to that shown above in FIGS. 1–12 except that the device is connected to a door 14' and the cable 20' is coupled to the frame 12'. In this instance, the door 14' can be lightweight, such as a screen door, and thus an auxiliary roller 144 is advantageously rotatably connected to the door at a position spaced away from the retraction device 10''. This roller 144 engages a downwardly facing portion 145 of the frame 12' and rolls there against. Thus, any tendency for the lightweight door 14' to bind on the frame 12' under the power of the retraction device 10'' is counteracted by the auxiliary roller 144.

While various advantageous embodiments have been chosen to illustrate the invention, it will be understood by those skilled in the art that various changes and modifications can be made therein without departing from the scope of the invention as defined in the appended claims.

What is claimed is:

1. A retractor, the combination comprising:

a housing;

a drum rotatably supported in said housing;

power means, comprising a constant force spring supported in said housing, for rotating said drum in a first direction after said drum has been rotated in a second, opposite direction;

connecting means, coupled to said power means and said drum, for connecting said power means to said drum; and brake means, coupled to said power means, for controlling said power means, thereby controlling the rotational speed of said drum in said first direction, said brake means comprising means, responsive to the rotational speed of said drum, for varying the braking force of said brake means, said power means further comprising a storage drum and an output drum located in said housing and supporting said constant force spring, said storage drum and output drum being located substantially in the same first plane, said brake means and said drum rotatably supported in said housing being located substantially in the same second plane, said first and second planes being substantially parallel and offset from one another.

2. A retractor according to claim 1, and further comprising means, coupled to said brake means, for adjusting the braking force of said brake means.

3. A retractor according to claim 2, wherein said housing has an aperture located adjacent said means for adjusting the braking force of said brake means to permit external access thereto.

4. A retractor according to claim 1, and further comprising an aperture located in said housing, a cable wrapped around said drum, passing through said aperture, and having a first end coupled to said drum and a second end adapted to be coupled to the device to be retracted.

5. A retractor according to claim 1, and further comprising a rim coupled to said drum for rotation therewith, said rim having at least a portion located outside said housing.

6. A retractor according to claim 1, and further comprising one-way clutch means, coupled between said power means and said brake means, for actuating said brake means only when said drum is rotating in said first direction.

7. A panel closer for a panel mounted for movement relative to a fixed frame, the combination comprising:

a housing rigidly coupled to either the panel or the frame and having an aperture;

a spool rotatably supported in said housing;

a cable wrapped around said spool, passing through said aperture, and having a first end coupled to said spool and a second end coupled to the other of the panel or the frame;

power means, comprising a constant force spring supported in said housing, for rotating said spool in a first direction after said spool has been rotated in a second, opposite direction by playing out of said cable upon opening of the panel;

connecting means, coupled to said power means and said spool, for connecting said power means to said spool; and brake means, coupled to said power means, for controlling said power means, thereby controlling the rotational speed of said spool and the speed at which the panel closes, said brake means comprising means, responsive to the rotational speed of said spool, for varying the braking force of said brake means, said power means further comprising a storage drum and an output drum located in said housing and supporting said constant force spring, said storage drum and output drum being located substantially in the same first plane, said brake means and said spool being located substantially in the same second plane, said first and second planes being substantially parallel and offset from one another.

8. A panel closer according to claim 7, wherein said brake means comprises a centrifugal brake.

9. A panel closer according to claim 8, wherein said centrifugal brake comprises an annular brake liner rigidly supported in said housing, a brake support rotatably supported in said housing and inside said brake liner, and a flyweight displaceably coupled to said brake support and having an outer braking surface engageable with said brake liner upon rotation of said brake wheel.

10. A panel closer according to claim 8, wherein said centrifugal brake further comprises means for adjusting the braking force of said centrifugal brake.

11. A panel closer for a panel mounted for movement relative to a fixed frame, the combination comprising:

a housing rigidly coupled to either the panel or the frame and having a first aperture;

a spool rotatably supported in said housing;

a cable wrapped around said spool, passing through said aperture, and having a first end coupled to said spool and a second end coupled to the other of the panel or the frame;

power means, supported in said housing, for rotating said spool in a first direction after said spool has been rotated in a second, opposite direction by playing out of said cable upon opening of the panel;

connecting means, coupled to said power means and said spool, for connecting said power means to said spool; and brake means, coupled to said power means, for controlling said power means, thereby controlling the rotational speed of said spool and the speed at which the panel closes, said brake means comprising means, responsive to the rotational speed of said spool, for varying the braking force of said brake means, said brake means comprising a centrifugal brake and means for adjusting the braking force of said centrifugal brake, said means for adjusting the braking force comprising a cam, and means, coupled to said centrifugal brake, for adjusting the position of said cam.

12. A panel closer according to claim 11, and further comprising a second aperture located in said housing adjacent said means for adjusting to permit external access thereto.

13. A panel closer for a panel mounted for movement relative to a fixed frame, the combination comprising:

a housing rigidly coupled to either the panel or the frame and having a first aperture;

a spool rotatably supported in said housing;

a cable wrapped around said spool, passing through said aperture, and having a first end coupled to said spool and a second end coupled to the other of the panel or the frame;

power means, comprising a constant force spring supported in said housing, for rotating said spool in a first direction after said spool has been rotated in a second, opposite direction by playing out of said cable upon opening of the panel;

means, coupled to said power means and said spool, for connecting said power means to said spool;

brake means for controlling said power means, thereby controlling the rotational speed of said spool and the speed at which the panel closes; and transmission means, comprising a gear train, for connecting said power means and said brake means, said power means further comprising a storage drum and an output drum located in said housing and supporting said constant force spring, said storage drum and output drum being located substantially in the same first plane, said brake means and said spool being located substantially in the same second plane, said first and second planes being substantially parallel and offset from one another.

14. A panel closer according to claim 13, and wherein said gear train comprises a drive gear coupled to said power means and having gear teeth thereon, an idler gear rotatably coupled to said housing and having a first set of gear teeth engaging said gear teeth on said drive gear and a second set of gear teeth, and a brake support coupled to said brake means and having gear teeth thereon engaging said second set of gear teeth on said idler gear.

15. A panel closer according to claim 13, and further comprising means, coupled to said brake means, for adjusting the braking force of said brake means.

16. A panel closer according to claim 15, wherein said housing has a second aperture located adjacent said means for adjusting the braking force of said brake means for external access thereto.

17. A panel closer for a panel mounted for movement relative to a fixed frame, the combination comprising:

a housing rigidly coupled to either the panel or the frame and having a first aperture;

an output shaft rotatably supported in said housing;

a spool rigidly coupled to said output shaft;

a cable wrapped around said spool, passing through said aperture, and having a first end coupled to said spool and a second end coupled to the other of the panel or the frame;

a brake shaft rotatably supported in said housing;

a storage drum rotatably coupled to said brake shaft;

an output drum rigidly coupled to said output shaft and having at least one radially inwardly facing one-way clutch tooth thereon;

a coiled constant force spring wrapped around said storage drum and said output drum and having a first end coupled to said storage drum and a second end coupled to said output drum;

a drive gear rotatably supported on said output shaft and having gear teeth thereon and at least one radially outwardly facing one-way clutch tooth thereon engageable with said radially inwardly facing clutch tooth on said output drum;

an idler shaft rigidly coupled to said housing;

an idler gear rotatably coupled to said idler shaft and having a first set of gear teeth engaging said gear teeth on said drive gear and a second set of gear teeth;

a brake support rotatably coupled to said brake shaft and having gear teeth thereon engaging said second set of gear teeth on said idler gear;

an annular brake liner rigidly supported in said housing and enclosing said brake support; and a flyweight displaceably coupled to said brake support and having an outer braking surface engaging said brake liner upon rotation of said brake support, said storage drum and said output drum being located in said housing and being located substantially in the same first plane, said brake support and said spool being located substantially in the same second plane, said first and second planes being substantially parallel and offset from one another.

18. A panel closer according to claim 17, and further comprising a roller coupled to the panel for rotation and rotatably engaging the fixed frame.

19. A panel closer for a panel mounted for movement relative to a fixed frame, the combination comprising:

a housing rigidly coupled to either the panel or the frame and having a first aperture;

an output shaft rotatably supported in said housing;

a spool rigidly coupled to said output shaft;

a cable wrapped around said spool, passing through said aperture, and having a first end coupled to said spool and a second end coupled to the other of the panel or the frame;

a brake shaft rotatably supported in said housing;

a storage drum rotatably coupled to said brake shaft;

an output drum rigidly coupled to said output shaft and having at least one radially inwardly facing one-way clutch tooth thereon;

a first coiled constant force spring wrapped around said storage drum and said output drum and having a first end coupled to said storage drum and a second end coupled to said output drum;

a drive gear rotatably supported on said output shaft and having gear teeth thereon and at least one radially outwardly facing one-way clutch tooth thereon engageable with said radially inwardly facing clutch tooth on said output drum;

an idler shaft rigidly coupled to said housing;

an idler gear rotatably coupled to said idler shaft and having a first set of gear teeth engaging said gear teeth on said drive gear and a second set of gear teeth;

a brake support rotatably coupled to said brake shaft and having gear teeth thereon engaging said second set of gear teeth on said idler gear;

an annular brake liner rigidly supported in said housing and enclosing said brake support;

a flyweight displaceably coupled to said brake support and having an outer braking surface engaging said brake liner upon rotation of said brake support;

a cam pivotally coupled to said brake support; and a second coiled spring coupled to said brake support, said second coiled spring having a first end engaging said cam and a second end engaging said flyweight.

20. A panel closer according to claim 19, wherein said housing has a second aperture, and said cam has a plurality of teeth rigidly coupled thereto and located adjacent said second aperture for reception of a tool maneuvered through said second aperture for adjusting the angular position of said cam relative to said spring via rotation of said plurality of teeth.

21. A panel closer for a panel mounted on a slide having a fixed frame located adjacent thereto, the combination comprising:

a housing rigidly coupled to either the panel or the frame;

a drum rotatably supported on said housing and having a rim coupled thereto for rotation therewith, said rim frictionally engaging said slide;

power means, comprising a constant force spring supported in said housing, for rotating said drum in a first direction after said drum has been rotated in a second, opposite direction by rotation relative to said slide upon opening of the panel;

connecting means, coupled to said power means and said drum, for connecting said power means to said drum; and brake means, coupled to said power means, for controlling said power means, thereby controlling the rotational speed of said drum and the speed at which the panel closes, said braking means comprising means, responsive to the rotational speed of said drum, for varying the braking force of said brake means, said power means further comprising a storage drum and an output drum located in said housing and supporting said constant force spring, said storage drum and output drum being located substantially in the same first plane, said brake means and said drum rotatably supported on said housing being located substantially in the same second plane, said first and second planes being substantially parallel and offset from one another.

22. A panel closer according to claim 21, and further comprising means, coupled to said brake means, for adjusting the braking force of said brake means.

* * * * *